US006761352B2

(12) United States Patent
Scicluna et al.

(10) Patent No.: US 6,761,352 B2
(45) Date of Patent: Jul. 13, 2004

(54) METHOD AND SYSTEM FOR DOUBLE FEED DETECTION

(75) Inventors: Charles Paul Scicluna, Mississauga (CA); Jeffrey Charles Neal, Amherstburg (CA); Douglas Craig Browne, Lasalle (CA)

(73) Assignee: Omron Canada Inc., Ontario (CA)

( * ) Notice: Subject to any disclaimer, the term of this patent is extended or adjusted under 35 U.S.C. 154(b) by 119 days.

(21) Appl. No.: 10/235,842

(22) Filed: Sep. 6, 2002

(65) Prior Publication Data

US 2003/0091236 A1 May 15, 2003

(30) Foreign Application Priority Data

Nov. 14, 2001 (CA) ..... 2361969

(51) Int. Cl.[7] ..... B65H 1/18; B65H 1/16

(52) U.S. Cl. ..... 271/153; 271/154; 271/263; 271/258.04; 271/258.01; 324/635; 324/644; 324/662; 324/671; 324/691; 324/716; 101/73

(58) Field of Search ..... 324/635, 644, 324/662, 671, 691, 716; 271/152, 153, 154, 663, 258.01, 258.02, 258.03, 258.04; 101/73

(56) References Cited

U.S. PATENT DOCUMENTS

| | | | | |
|---|---|---|---|---|
| 3,937,453 A | | 2/1976 | Hickey et al. | |
| 4,160,546 A | | 7/1979 | McMillan et al. | |
| 4,179,031 A | | 12/1979 | Ward | |
| 4,255,651 A | | 3/1981 | Phillips | |
| 4,397,460 A | | 8/1983 | Milanes et al. | |
| 4,516,264 A | * | 5/1985 | Corvari et al. | 382/101 |
| 4,630,813 A | | 12/1986 | Watanabe et al. | |
| 4,694,474 A | | 9/1987 | Dorman et al. | |
| 4,733,226 A | | 3/1988 | Kasuya et al. | |
| 4,741,526 A | | 5/1988 | Reed | |
| 4,998,998 A | | 3/1991 | Shigetoshi et al. | |
| 5,017,773 A | | 5/1991 | Sato | |
| 5,040,196 A | | 8/1991 | Woodward | |
| 5,132,791 A | * | 7/1992 | Wertz et al. | 348/88 |
| 5,174,562 A | | 12/1992 | Mizunaga et al. | |
| 5,221,837 A | | 6/1993 | Walgren et al. | |
| 5,249,794 A | | 10/1993 | Plent et al. | |
| 5,502,312 A | | 3/1996 | Lorenzo | |
| 5,534,690 A | | 7/1996 | Goldenberg et al. | |
| 5,697,610 A | | 12/1997 | Holmes et al. | |

FOREIGN PATENT DOCUMENTS

| | | |
|---|---|---|
| DE | 198 42 192 | 3/2000 |
| FR | 2 057 309 | 5/1971 |
| FR | 2 546 083 | 11/1984 |
| WO | WO 94/17387 | 8/1994 |

* cited by examiner

*Primary Examiner*—Donald P. Walsh
*Assistant Examiner*—Kenneth W Bower
(74) *Attorney, Agent, or Firm*—Morrison & Foerster LLP

(57) ABSTRACT

A system for detecting overlapped flat objects in a sequence of flat objects have at least one of their edges exposed for viewing as they pass along a feed path. The system includes a sensor for generating a signal in response to detecting a flat object in the feed path and a camera responsive to the signal for capturing a digital image of the exposed edges of the detected flat object in the feed path. A vision system is coupled to the camera for receiving the digital image. The vision system analyzes at least a portion of the image to determine a pixel density variation along a direction perpendicular to the edges and uses the pixel density variation to output an indication of the number of edges in the image.

25 Claims, 10 Drawing Sheets

```
BEGIN

Check if the mailpiece is thick or thin.

IF the mailpiece is thick THEN

        Use low sensitivity settings to count the number of edges (i.e. low sensitivity settings ignore wrinkles and creases often
        found in thick envelopes.)

        IF the number of edges is <2 THEN

                Output to controller = OK

        ELSE IF number of edges >=2 THEN

                Output to controller = Double Feed

        END IF

ELSE IF the mailpiece is thin THEN

        Use high sensitivity settings to count the number of edges (i.e. high sensitivity settings pick up dark colored mailpieces
        better)

        IF the number of edges is <2 THEN

                Output to controller = OK

        ELSE IF number of edges >2 THEN

                Output to controller = Double Feed

        ELSE IF number of edges =2 THEN

                IF edge pitch is small THEN

                        Output to controller = OK

                ELSE

                        Output to controller = Double Feed

                END IF

        END IF

END IF

END
```

FIG. 8

METHOD AND SYSTEM FOR DOUBLE FEED DETECTION

This application claims priority from Canadian Patent Application No. 2,361,969 filed Nov. 14, 2001, and incorporated herein by reference.

The present invention relates to a method and apparatus using digital imaging and processing for detecting overlapped flat objects in a sequence of flat objects. More particularly, the invention is applicable to the detection of double or multiple fed mail pieces in a mail sorting apparatus.

BACKGROUND OF THE INVENTION

Mechanisms for minimizing multiple feeds when processing a stack of flat objects are well known. For example, sheet feeders, bank note readers and mail piece sorting systems all employ feed mechanisms for picking off work pieces sequentially and singly from an input stack for transport along a feed path at relatively high speed.

In a mail sorting system, the mail pieces are essentially flat rectangular objects having a pair of large flat surfaces and four edges, and the mail pieces are arranged with their planar surfaces along a common axis to form a stack.

A feeder mechanism picks off individual mail pieces from an input stack to an OCR (Optical Character Reader) which reads a forwarding address printed on the mail piece and directs the mail piece to one of several output stacks corresponding to the destination address. The feed rate of such sorting apparatus is typically several thousand mail pieces per hour, so occasionally more than one mail piece is picked off by the feeder resulting in a multiple feed, also referred to in the art as a double feed. Multiple feeds pose a problem in that two or more mail pieces may end up in the wrong destination stack with the result that the misfed mail pieces are not delivered on time. Furthermore, multiple fed mail pieces may cause jamming within the stacker apparatus. Both of these problems are costly. Accordingly, the benefits of detecting multiple fed mail pieces are evident, and particularly if the multiple feeds are detected as early as possible in the feed path.

A "double feed" is characterized by two or more mail pieces being stuck together generally along their flat sides with either one or more edges completely or partially overlapped. While current double feed detection systems will detect a partial or complete overlap, few are capable of also distinguishing a false double feed, which occurs when a relatively thick mail piece with a crinkled or creased edge is picked off or when the mail piece has a dark color, is multicolored or has a fold over. Of course, the detection of false double feeds should be avoided.

There are a number of disadvantages with current techniques for detecting double feeds. For example, U.S. Pat. No. 4,733,226 describes a system for detecting overlapped mail pieces where one mail piece hides another in the feed path. A scanner is arranged along the feed path to detect the height of the mail piece as it moves past the scanner. Any changes in the height of mail pieces signals an overlap condition. As the system is limited to detecting variations in height, it cannot be used to detect an overlap where the mail pieces are the same height or where the mail pieces are fully overlapped. In U.S. Pat. No. 4,160,546, there is described a system which uses changes in document translucency to trigger an overlap indication. While this system may be effective for detecting documents that are translucent and have similar characteristics, it is not as effective for mail pieces which are typically opaque.

Also, imaging techniques for counting stacks of flat objects are known, however these techniques have limitations when used for double feed detection. For example, U.S. Pat. No. 5,534,690 describes a system for counting the number of bank notes in a stack by imaging the entire side of a stack while the stack is kept stationary. The system determines the number of items in the stack by taking two images of the side of the stack at different illuminations. The number of lines in the two images is compared. The average number of lines between the two images indicates the number of items in the stack. A limitation of this system is that the stacked items must be stationary so that a meaningful comparison can be made between the two images. Accordingly, this technique cannot be used for determining double feeds in a moving stream of objects such as in a mail sorting apparatus. Other patents that describe counting techniques are, for example, disclosed in U.S. Pat. No. 5,221,837.

A need therefore exists for the effective detection of double feeds, including both partially overlapped and fully overlapped mail pieces, in a mail sorting and handling apparatus, while the mail pieces are in motion. Furthermore, there is a need for a double feed detection (DFD) system that can detect double feeds where the objects have different heights, different colors, and different widths and with crinkled edges with minimal impact on feed mechanisms or existing sorters.

SUMMARY OF THE INVENTION

The invention provides a double feed detection system and method for detecting two or more mail pieces (e.g. envelopes), either partially or fully overlapped, passing simultaneously through a mail sorting and handling apparatus.

The DFD system includes a vision system with a digital camera for capturing and analyzing images of the bottom edges of mail pieces as they pass through the mail sorting apparatus, multiple photosensors for detecting and tracking the mail pieces through the mail sorting apparatus, and a controller for system control, system fault monitoring, and outputting double feed rejection signals to the mail sorting apparatus to enable the re-routing of detected double feeds.

In particular, according to one aspect of the invention, a system is provided for detecting overlapped flat objects in a sequence of flat objects, where the flat objects have at least one of their edges exposed for viewing as they pass along a feed path. The system includes: a sensor for generating a signal in response to detecting a flat object in the feed path; a camera responsive to the signal for capturing a digital image of the exposed edges of the detected flat object in the feed path; and a vision system coupled to the camera for receiving the digital image. The vision system analyzes at least a portion of the image to determine a pixel density variation along a direction perpendicular to the edges and uses the pixel density variation to output an indication of the number of edges in the image.

The DFD method is implemented in part by software run by the vision system. According to this method, an image of the bottom edges of a mail piece is captured and an inspection is performed on at least a portion of this image to determine if the mail piece is of a predetermined thickness. If the mail piece is of the predetermined thickness, low sensitivity settings of the expected average edge width are used by the software to count the number of edges. If the mail piece is less than the predetermined thickness, high sensitivity settings of the expected average edge width are used to count the number of edges. If the mail piece is of the predetermined thickness and the measured number of edges is less than two, there is no double feed and an output from the vision system to the controller indicates an "OK" condition for the mail piece. On the other hand, if the mail piece is of the predetermined thickness and the measured number of edges is not less than two, there is a double feed and the output to the controller indicates a "Double Feed" condition for the mail piece. If the mail piece is less than the predetermined thickness and the measured number of edges is less than two, there is no double feed condition and the output to the controller indicates an "OK" condition for the mail piece. If the mail piece has less than the predetermined thickness and the measured number of edges is greater than two, there is a double feed and the output to the controller indicates a "Double Feed" condition for the mail piece. Finally, if the mail piece has less than the predetermined thickness and the measured number of edges is equal to two and the measured edge pitch is smaller than a predetermined threshold, there is no double feed and the output to the controller indicates an "OK" condition for the mail piece. On the other hand, if the mail piece has less than the predetermined thickness, the measured number of edges is equal to two and the measured edge pitch is greater than a predetermined threshold, there is a double feed and the output to the controller indicates a "Double Feed" condition for the mail piece.

In particular, according to another aspect of the invention, a method is provided for detecting overlapped flat objects in a sequence of flat objects where the flat objects have at least one of their edges exposed for viewing as they pass along a feed path. The method includes the steps of: selecting a flat object in the feed path; capturing a digital image of the exposed edges of the selected flat object; processing at least a portion of the captured image encompassing the edges to determine a pixel density variation in a direction across the edges; analyzing the pixel density variation to identify maxima and minima in the variation, where a start of an edge is identified by a maximum and an end of an edge is identified by a minimum; and, counting the maxima and minima to output an indication of the number of edges in the image. The method may further include determining an edge width of the flat object. The method of determining an edge width of the flat object may include: computing an average pixel density for the processed portion; assuming a first edge width if the average density is below a predetermined level; and, assuming a second edge width if the average density is above the predetermined level. The method of counting may further include: counting maximum and minimum pairs that are spaced by less than the first edge width if the average density is below the predetermined level to output the indication of the number of edges; and, counting maximum and minimum pairs that are spaced by more than the second edge width if the average density is above the predetermined level to output the indication of the number of edges.

The DFD method is also implemented in part by software that is run on the controller. The controller receives outputs from the vision system indicating that each passing mail piece is either "OK" or is a "Double Feed". The controller analyzes these outputs from the vision system, information from multiple photosensors that track the progress of mail pieces through the mail sorting, and monitored fault information to determine when or if a double feed rejection signal should be sent to the mail sorting apparatus to enable the re-routing of detected double feeds.

BRIEF DESCRIPTION OF THE DRAWINGS

Embodiments of the invention may best be understood by referring to the following description and accompanying drawings in which:

FIGS. 6(*b*) and 6(*c*) show a schematic diagram of the screen image of FIG. 6(*a*) and its corresponding density variation;

FIG. 8 is a pseudocode listing corresponding to the flow chart of FIG. 7.

DETAILED DESCRIPTION OF THE INVENTION

Figure 1:
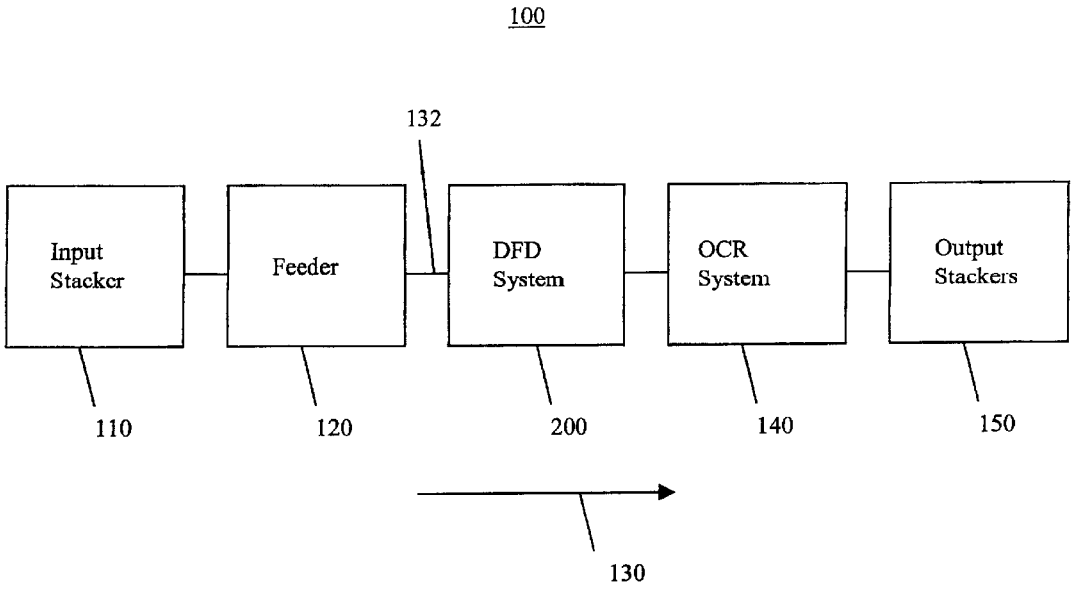
FIG. 1 is a block diagram illustrating a mail sorting system with an incorporated DFD system in accordance with an embodiment of the invention.

In the following description, like numerals refer to like structures and/or processes in the drawing. Furthermore the invention will be described in the context of a mail sorting application, however this is merely exemplary and not limiting of the general applicability of the invention.

FIG. 1 is a block diagram of a mail sorting system 100 which includes a double feed detection (DFD) system 200 in accordance with an embodiment of the invention. The mail sorter 100 includes an input stacker 110 for supporting a stack of mail pieces to be sorted, a feeder mechanism 120 for picking off mail pieces, preferably one at a time, and transporting them by a conveyor belt sequentially along a feed path 132 past an OCR (optical character recognition) system 140 to one or more destination bins or output stacks 150. The OCR system 140 is used to determine the destination address of the mail piece and thereby control an appropriate gate to a destination bin. The arrow 130 indicates the direction of flow of the mail piece along the feed path 132.

The feeder mechanism 120 typically picks off mail pieces at a rate of several thousand per hour and may not always pick off a single mail piece from the input stacker, but may instead pick off two or more overlapped mail pieces.

Accordingly, the present invention addresses this problem by providing a DFD system 200 for detecting double feeds and initiating appropriate action to the sorter, such as providing a signal to divert overlapped mail pieces from the feed path 132 to a rejection bin.

The DFD system 200 is preferably located between the feeder 120 and the OCR 140 and generally provides three functions: edge detection, overlap detection, and mail piece tracking.

Figure 2:
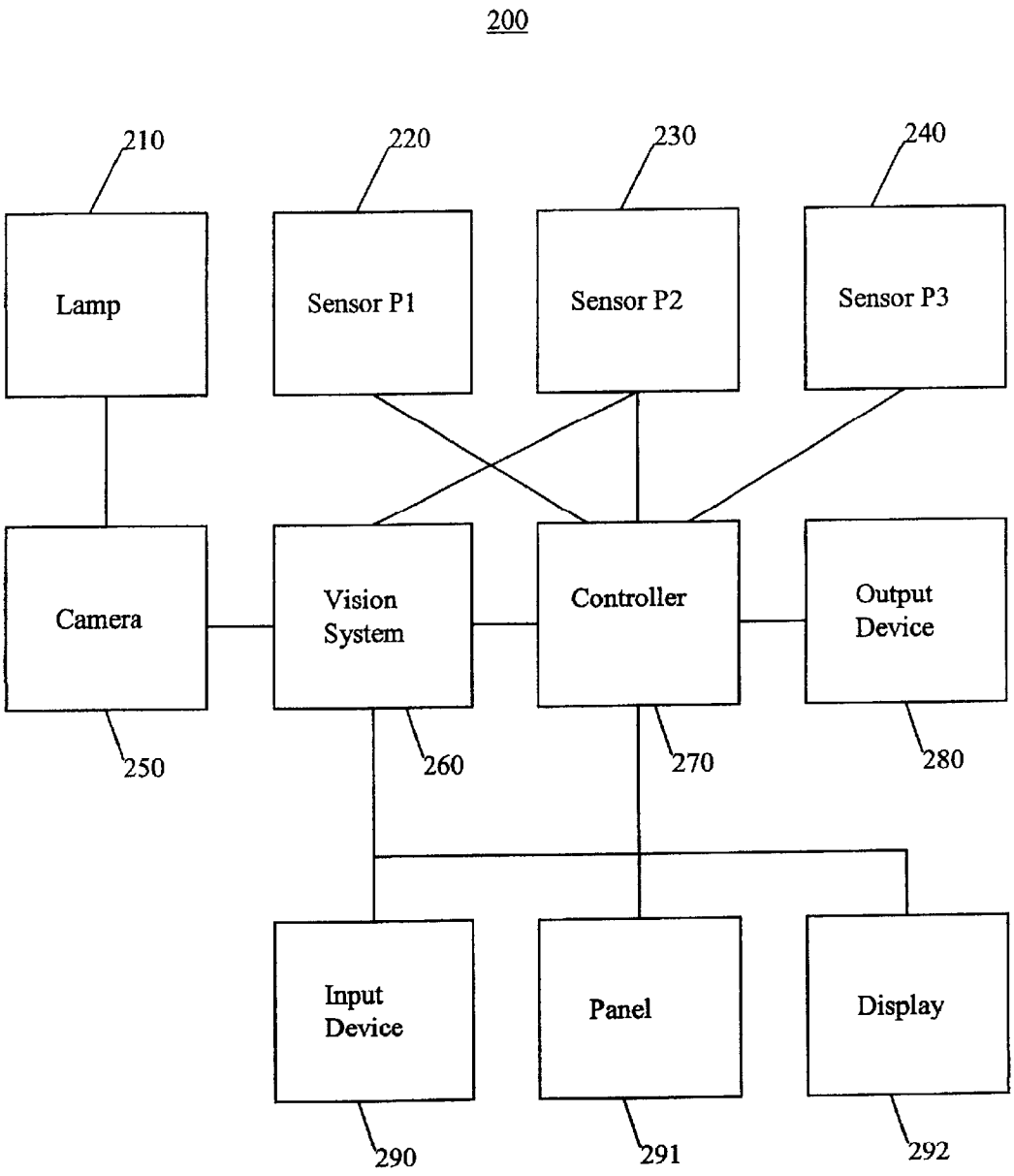
FIG. 2 is a block diagram illustrating a double feed detection ("DFD") system in accordance with an embodiment of the invention.

FIG. 2 is a block diagram of a DFD system 200 in accordance with an embodiment of the invention. The DFD system 200 includes a programmable logic controller (PLC) 270 which is interfaced to a vision system 260 and its associated camera and lamp 210 for edge detection; photo sensors P1, P2, P3 positioned along the feed path for overlap detection, triggering the vision system and mail piece tracking; an output device 280; and a system panel 291. The output device 280 provides double feed rejection signals generated by the DFD system 200 to the sorter system 100. The output device 280 may also include a CD-ROM, a floppy disk, a printer, a digital output (e.g. solid state device or relay contact), or a network connection. The panel 291 may include an input device 290 and a display 292. The input device 290 may include a keyboard, mouse, trackball, control switches, or similar devices. The display 292 may include a CRT screen, LCD screen, indication lamps, or similar devices. The vision system 260 includes image-processing software for computing the number of edges in a passing mail piece. The vision system is coupled to receive inputs from the photosensor P2 230 and the camera 250. The vision system 260 may also be interfaced to an input device 290 and display 292 either directly or through a panel 291. As will be described below, the vision system 260 provides a double feed indication to the controller 270. The vision system 260 and controller 270 may be a single unit. The vision system 260 and/or controller 270 may include an input device, a central processing unit or CPU, memory, a display, and an output device. The CPU may include dedicated co-processors and memory devices. The memory may include RAM, ROM, databases, or disk devices.

The DFD system 200 may be implemented with the following hardware components, available from Omron Canada Inc., or equivalents: Lamp 210: Model 101K12351; Photosensors 220, 230, 240 Model E32-T14 with amplifier E3X-F21; Camera 250 Model F150-S1A; Vision System 260 Model F150-C10E-3 with console F150-KP; Controller 270 Model CPM2C-20CDTC-D; Output Device 280 Model CPM2C-20CDTC-D (digital outputs); Input Device 290 Model NT2S-SF123B-E (function keys); Display Model 292 NT2S-SF123B-E (2 line LCD display). Persons skilled in this art will recognize that the method and system of this invention can be implemented with a wide variety of hardware components suitable to perform the disclosed functions. Each of the functions performed by the DFD system 200 will be described in more detail below.

Edge Detection Using a Vision System. Edge detection may be better understood by referring now to FIG. 3, which is a block diagram of the relative positions of the various components in the DFD system 200 according to an embodiment of the present invention. For clarity, the conveyor belts and mechanical devices for moving mail pieces 310 along the feed path 130, 132 are well known and have been omitted. For illustrative purposes, a typical single fed mail piece is indicated by the numeral 310, while a typical double feed is indicated by the numeral 320. The double feed 320 is shown as two overlapped envelopes 321, 322.

Mail pieces 310 typically pass along the feed path 130, 132 in an upright orientation with at least one of their edges 330 visible to the camera 250, which is positioned below the feed path 130. Typically, the visible edge is at least the bottom edge of one mail piece 310 and passes through an imaging region of the camera lens. The photocell sensor P2 230 is positioned in the feed path 130, 132 such that the camera 250 is triggered when a leading edge of the mail piece 310 passes the sensor 230 and the camera 250 captures images of the bottom edges 330 of passing mail pieces 310. The lamp 210 is directed toward the bottom edges 330 to illuminate them for improved image capture by the camera 250. The camera lens 250 need not be mounted perpendicular to the mail piece path 130, 132 but may be mounted at an angle to the feed path 130, 132.

The imaging region of the camera is spaced a distance L, along the feed path, from photosensor P2 230 such that when a mail piece 310 is detected by photosensor P2 230, a signal is sent by the photosensor P2 230 to the vision system 260, which in turn controls the camera 250 to capture an image of the bottom edge 330 of the passing mail piece 310. This distance is chosen so that the camera captures an image of the bottom edge 330 of the shortest allowable mail piece 310 passing along the feed path 130. For example, if the shortest allowable bottom edge of the mail piece 310 is 140 mm, then the camera 250 would typically be spaced approximately 130 mm from photosensor P2 230.

Once the image is captured, the digital image-processing software executed by the vision system 260 is used to analyze the image 600 to determine the number of edges present using any method known in the art.

Figure 6:
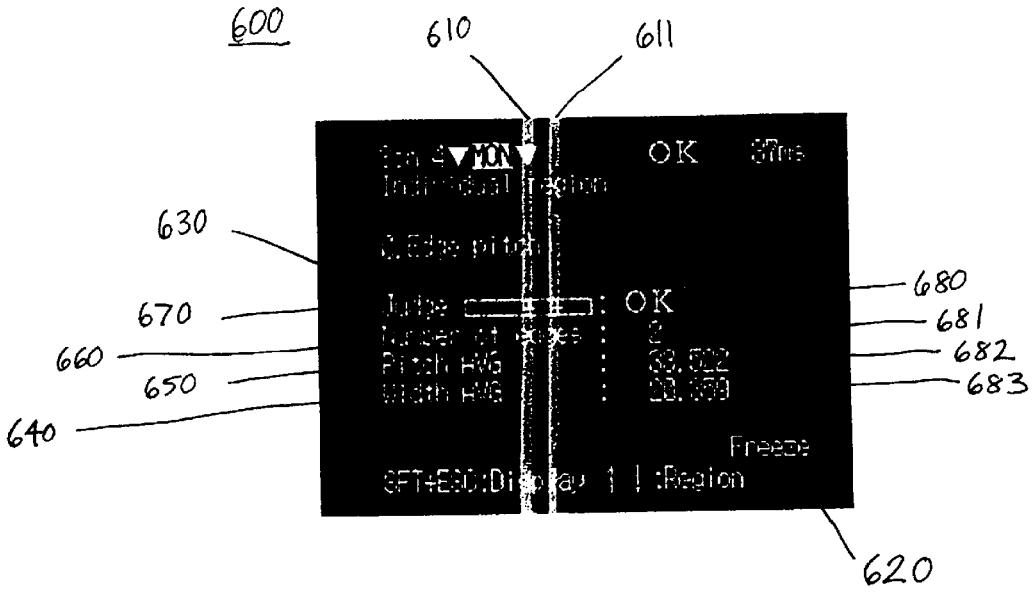
FIG. 6(*a*) is a screen capture illustrating an image of mail piece bottom edges captured by a camera.
Figure 6:
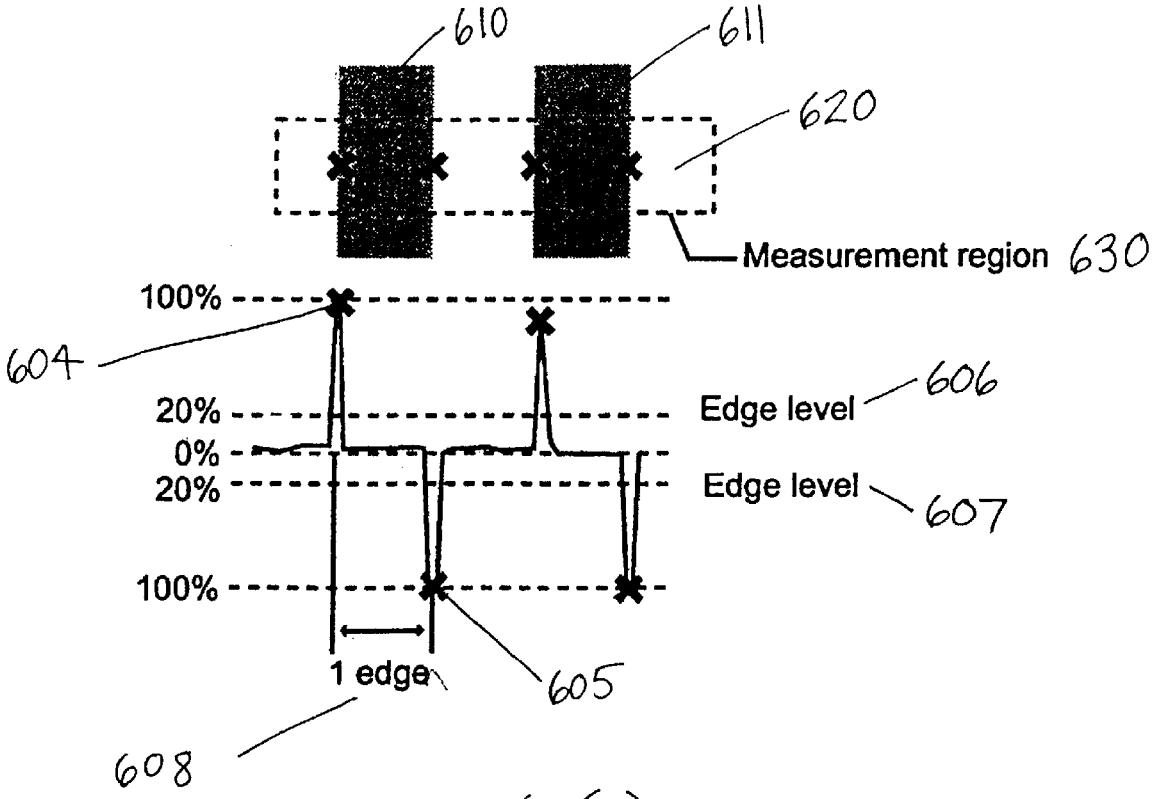

The operation of the edge determination function may be better understood by referring to FIGS. 6(*a*), 6(*b*), and 6(*c*).

FIG. 6(*a*) is a screen capture illustrating an image 600 of mail piece bottom edges 330 captured by a camera 250. The image 600 is typically stored digitally in the memory of the vision system 260. The image 600 may also be displayed to a user on the display 292. The bottom edge 330 of the mail piece 310 typically appears as a line 610 against a background 620 in the captured image 600. The image 600 contains two lines 610, 611, indicating that the mail piece 310 has two bottom edges 330. Hence, the mail piece 310 may consist of two envelopes.

In order for the software to perform the edge detection analysis, the user defines a measurement region 630 in which to perform a density variation analysis within the captured image 600. This region will encompass the mail piece bottom edges 330 passing along the feed path 130, 132.

The software determines the presence of edges through an analysis of pixel density variations across the selected measurement region 630 of the digital image. This may be understood from FIGS. 6(*b*) and 6(*c*) which are, respectively, a schematic representation of an acquired image in the measurement region 630 and a corresponding graph of the density variation as a percentage of dark to light pixels over the measurement region 630. In general, edges are detected by analyzing points on the density variation graph over the measurement region 630 and in a direction perpendicular to the edges. This perpendicular direction may be inferred by the software as the orientation of the camera 250, and hence the captured image 600, is known relative to the feed path direction 130. The points X correspond to maxima 604 and minima 605 that exceed an edge level threshold value 606, 607 and are detected as beginnings or ends of edges 608. The software counts the number of maxima and minima, and depending on the sensitivity settings (as explained below), infers the number of edges 608.

First, an average density threshold parameter for the measurement region 630 is specified by a user. The software will perform an average density inspection on the measurement region 630 to determine a measured average density. In general, the measured average density is the ratio of pixels corresponding to lines 610, 611 to pixels corresponding to background 620 within the measurement region 630. The software will compare the average density threshold parameter to the measured average density to determine if a mail piece is thick (i.e. large) or thin (i.e. small). If the measured average density is above the average density threshold parameter, then the mail piece will be considered to be thick. If the measured average density is below the average density threshold parameter, then the mail piece will be considered to be thin. The software will count the number of edges using a low sensitivity inspection for thick mail pieces and using a high sensitivity inspection for thin mail pieces.

Next, the user specifies a set of parameters for each of the low and high sensitivity inspections. These parameters are set by the user as follows: first, the user defines an expected average edge width parameter 640 for both thick and thin mail pieces; second, the user defines an expected average edge pitch parameter 650 also for both thick and thin mail pieces. The expected average edge pitch is the expected distance between the center of the edges of two double fed mail pieces 610, 611, 321, 322.

The user then defines a number of edges parameter 660 that will represent a single feed condition. This number will generally be "1". Finally, the user indicates to the software through a judgement parameter 670 that the entered parameters represent a single feed or "OK" condition. As will be described below, the software uses these parameters to determine if a double feed condition exists.

The low and high sensitivity values for the expected average edge width and edge pitch parameters allow for differentiated handling of thick, thin, and dark colored (e.g. red-striped edge envelopes) mail pieces. In general, thin mail pieces usually have crisp, well-defined edges. On the other hand, thick mail pieces often have creases and dents in their edges and, as such, they may be mistakenly considered as double feeds. Consequently, inspections are performed on the density variation at either high or low sensitivities. As mentioned above, the average density inspection is performed on the measurement region 630 to determine if the mail piece is thick or thin, and hence, select between the results of the low and high sensitivity inspections.

The high sensitivity inspection is performed to identify, for example, dark colored mail piece edges that do not generally show up well in the captured image 600 (i.e., dark colored mail pieces may be similar in color to the background). The high sensitivity inspection results in a first edge count. The low sensitivity inspection is performed to avoid false edge counts due to creases and dents in thick mail pieces. The low sensitivity inspection results in a second edge count. To choose between first and second edge counts, and consequently to determine if a double feed condition exists, the average density inspection is performed. If the average density inspection determines that the mail piece is thick, the second edge count (i.e. at low sensitivity) is chosen. If the average density inspection determines that the mail piece is thin, the first edge count (i.e. at high sensitivity) is chosen. The chosen edge count is used to determine if a double feed condition exists as will be described with reference to FIG. 7 below.

With respect to the first edge count (i.e. at high sensitivity), if the measured average density is below the average density threshold parameter (i.e. a thin mail piece), then the software produces the first edge count by counting maximum and minimum pairs 604, 605 that are spaced less than the high sensitivity expected average edge width setting 640. In this way, maxima and minima corresponding to each thin mail piece edge are generally included in the first edge count. With respect to the second edge count (i.e. at low sensitivity), if the measured average density is above the average density threshold (i.e. a thick mail piece), then the software produces the second edge count by counting maximum and minimum pairs 604, 605 that are spaced further than the low sensitivity expected average edge width setting 640. In this way, maxima and minima corresponding to creases and dents in thick mail piece edges are generally excluded from the second edge count. In general, the distance or spacing between a maximum 604 and a minimum 605 (i.e. measured edge width) or between maxima and minima pairs 604, 605 (i.e. measured edge pitch) may be measured by the software through a count of pixels along the density variation as shown in FIG. 6(*c*).

Figure 7:
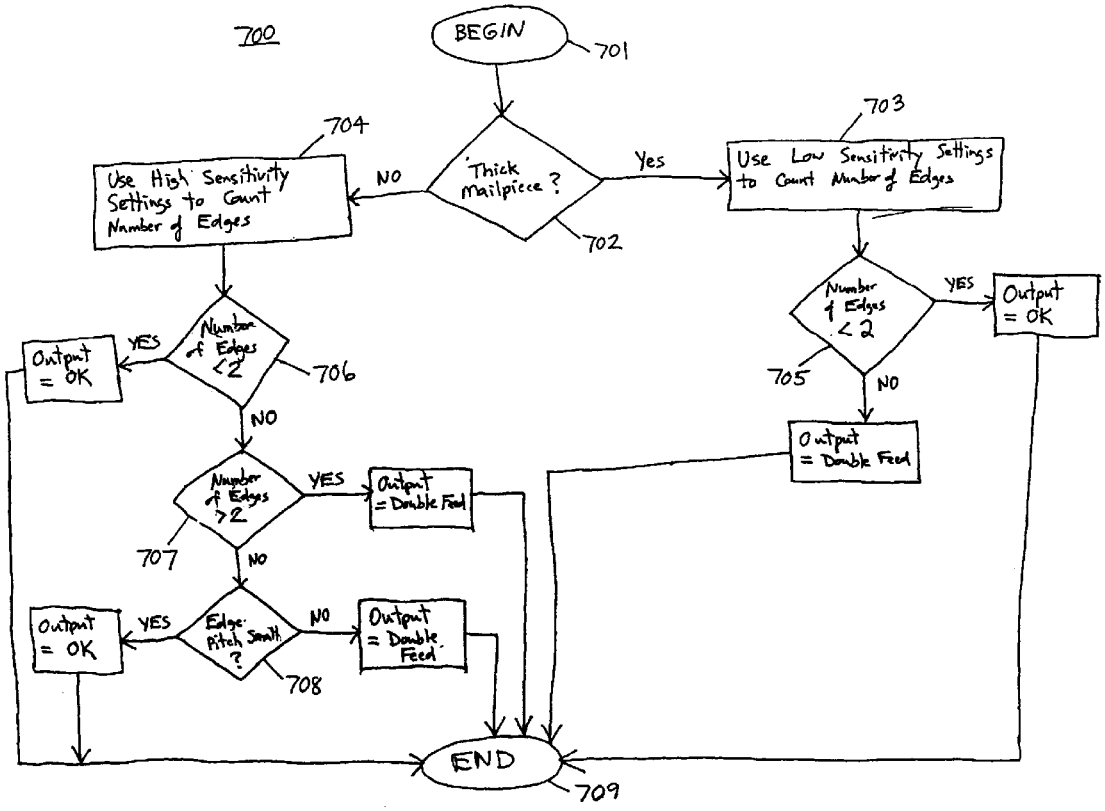
FIG. 7 is a flow chart illustrating a general method for detecting a double feed condition using a vision system in accordance with an embodiment of the invention.

FIG. 7 is a flow chart illustrating a general method for detecting a double feed condition using the vision system 260 in accordance with an embodiment of the invention. In FIG. 7, the flow chart is shown generally by numeral 700. At step 701, the method begins. At step 702, an inspection is performed to determine if the mail piece 310 is thick or thin. At step 703, if the mail piece is thick, low sensitivity settings are used by the software to count the number of edges. At step 704, if the mail piece is thin, high sensitivity settings are used to count the number of edges. At step 705, if the mail piece is thick and the measured number of edges 681 is less than 2, there is no double feed and the output to the controller 270 indicates an "OK" condition for the mail piece. On the other hand, if the mail piece is thick and the measured number of edges 681 is not less than 2, there is a double feed and the output to the controller 270 indicates a "Double Feed" condition for the mail piece. At step 706, if the mail piece is thin, and the measured number of edges 681 is less than 2, there is no double feed condition and the output to the controller 270 indicates an "OK" condition for the mail piece. At step 707, if the mail piece is thin and the measured number of edges 681 is greater than 2, there is a double feed and the output to the controller 270 indicates a "Double Feed" condition for the mail piece. At step 708, if the mail piece is thin and the measured number of edges 681 is equal to 2 and the measured edge pitch 682 is smaller than a predetermined threshold, there is no double feed and the output to the controller 270 indicates an "OK" condition for the mail piece. On the other hand, if the mail piece is thin and the measured number of edges 681 is equal to 2, and if the measured edge pitch 682 is greater than a predetermined threshold (i.e., expected average edge pitch), there is a double feed and the output to the controller 270 indicates a "Double Feed" condition for the mail piece. In this way, fold-overs, for example, may be distinguished from true double feeds. At step 709, the method ends.

FIG. 8 is a pseudocode listing corresponding to the flow chart of FIG. 7. Note that while the vision system 260 need not be programmed using a logic flow sequence, for clarity, the method illustrated by the flowchart of FIG. 7 is presented as pseudocode in FIG. 8.

Referring again to FIG. 6(*a*), where two edges 610, 611 are shown, the software has analyzed the measurement region 630 and has presented measured values 680, 681, 682, 683 for the judgement 670, number of edges 660, edge pitch average 650, and edge width average 640 parameters, respectively. While the measured number of edges 681 is "2", the software, based on a combination of criteria as described, provides a measured judgement 680 of "OK". In other words, a double feed condition does not exist even though two edges have been detected. The mail piece may be, for example, a "fold over" rather than two envelopes that have stuck together.

If a double feed condition exists, then a signal is output from the vision system 260 to the controller 270. This signal indicates if the mail piece is "OK" or if it is a "Double Feed".

Figure 3:
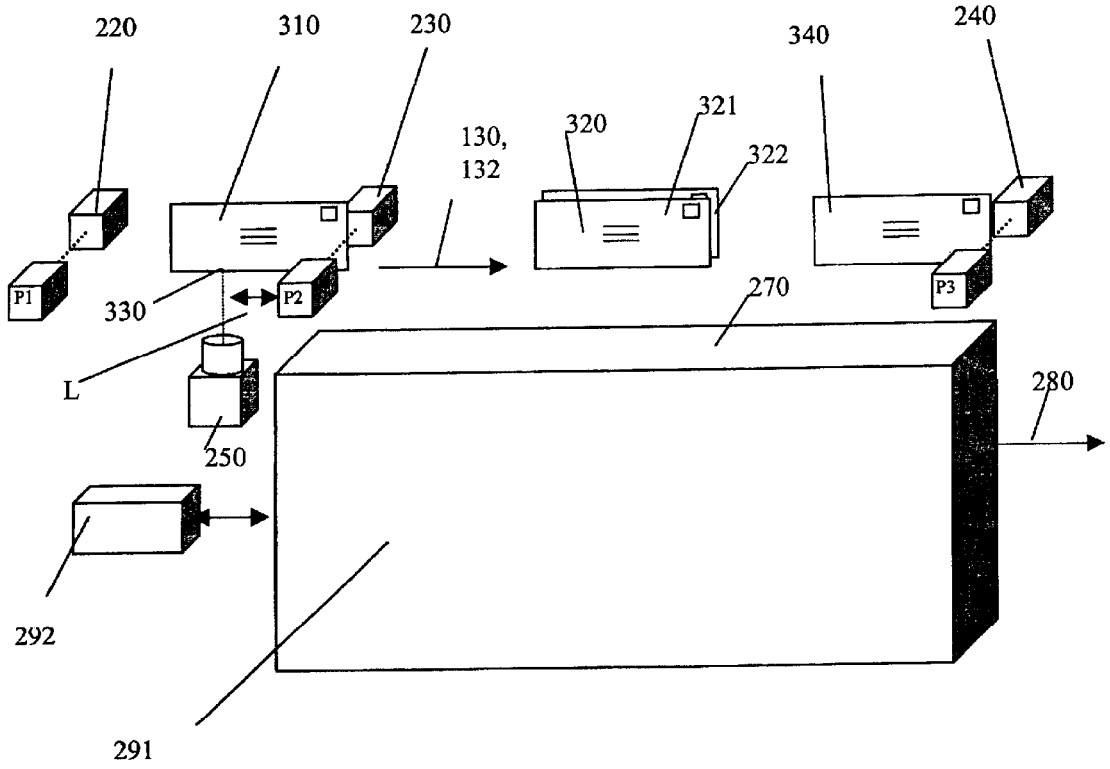
FIG. 3 is a simplified perspective view illustrating a DFD system in accordance with an embodiment of the invention.

Overlap Detection and Mail Piece Tracking Using Photosensors. Referring to FIGS. 1–3, the DFD system 200 includes three photosensors P1 220, P2 230, and P3 240. In general, the first two photosensors P1 220, P2 230 are used to detect a double feed condition in accordance with a further embodiment of the invention.

Figure 4:
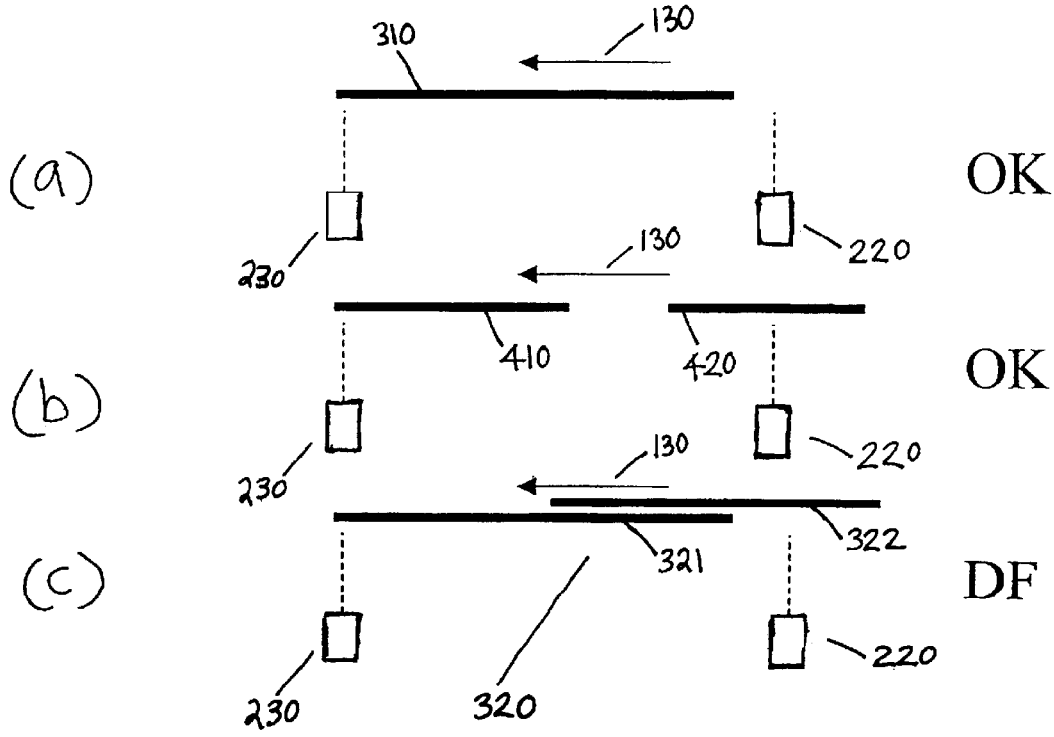
FIGS. 4(*a*), 4(*b*), and 4(*c*) are partial plan views of the DFD system illustrating the relationship between passing mail pieces and photosensors P1 and P2.

FIGS. 4(*a*), 4(*b*), and 4(*c*) are partial plan views of the DFD system 200 illustrating the relationship between passing mail pieces 310 and photosensors P1 220 and P2 230. Referring to FIG. 4(*a*), the first two photosensors P1 220, P2 230 are spaced in the mail piece path 130 at a distance greater than the length of the largest allowable mail piece (e.g. envelope) for the sorter 100. For example, if the maximum allowable length for a mail piece 310 is 260 mm, then the two photosensors P1 220, P2 230 may be spaced approximately 270 mm apart. Referring to FIGS. 4(*a*) and (*c*), as a mail piece 310 passes through the feeder 120 and into the OCR system 140, it turns on the first photosensor P1 220. If the first photosensor P1 220 remains on until the second photosensor P2 230 is turned on, a double feed 320 condition exists. If both photosensors P1 220, P2 230 are turned on simultaneously, this indicates that the mail piece is longer than the maximum allowable length, which may mean that two mail pieces 321, 322 are passing through the sorter at the same time. Referring to FIG. 4(*b*), note that if two small envelopes 410, 420 pass through the sorter one after the other, it is possible that photosensors P1 220 and P2 230 may both be turned on (i.e. tripped) simultaneously. This would not create a double feed condition 320 as the first photosensor P1 220 would turn off before the second photosensor P2 230 turns on. That is, the gap between the two small envelopes 410, 420 is recognized by the photosensors P1 220, P2 230.

The status of photosensors P1 220 and P2 230 is monitored by the controller 270. The second photosensor P2 230 is also monitored by the vision system 260. A signal is provided to the vision system 260 indicating that an image is to captured by the camera 250. As will be described below, the vision system 260 processes the image captured by the camera 250 to determine the number of edges of a passing mail piece 310 and, hence, whether there is a double feed. Thus, the DFD system 200 includes two means for detecting double feeds; a first and second photosensors means and a vision system means. Note that the DFD system 200 may operate with one or both of these double feed detection means.

Figure 5:
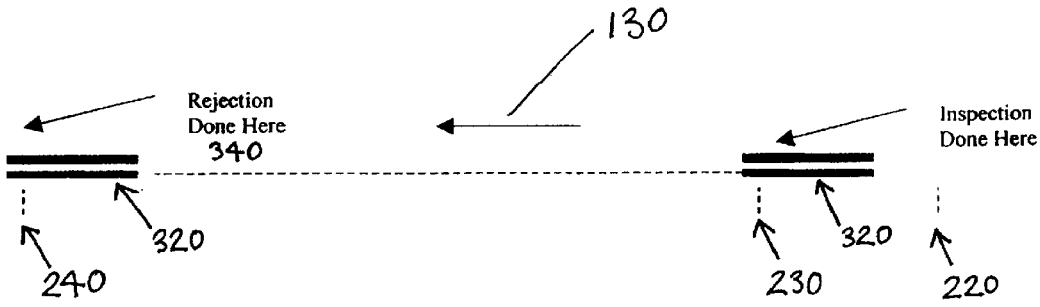
FIG. 5 is a partial plan view of the DFD system illustrating the relationship between passing mail pieces and photosensors P1, P2, and P3.

FIG. 5 is a partial plan view of the DFD system 200 illustrating the relationship between passing mail pieces 320 and photosensors P1 220, P2 230, and P3 240. The third photosensor P3 240 is required because double feed detection is typically performed by the DFD system 200 at a distance along the mail piece path 130 spaced before the spot 340 in the path 130 where a double feed rejection signal is typically issued by the DFD system 200, via its output device 280, to the sorter system 100. The third photosensor P3 240 allows the DFD system 200 to track the mail piece 320 through the sorter processing apparatus 140 and to provide the double feed rejection signal at the appropriate time.

DFD System Fault Detection. The DFD system 200 performs several self-diagnostic routines. In particular, the DFD system 200 monitors the number of double feeds detected to determine if a fault or malfunction has occurred. With respect to double feed counts, a fault may have occurred if the count is too low (i.e. a "too few double feeds fault") or too high (i.e. a "too many double feeds fault"). Normally, a number of double feeds will occur during a routine sorting operation. If no double feeds are detected, a malfunction may have occurred. For example, the camera lamp 210 may have burnt out. Typically, the DFD system 200 will generate a too few double feeds fault signal if a double feed has not been detected in the last 5,000 (or 10,000) mail pieces that have passed through the sorter 100. The too few double feeds fault may be automatically reset when the DFD system 200 subsequently detects a double feed.

A second type of fault that the DFD system 200 checks for is too many double feeds. This condition may indicate a more severe malfunction in the DFD system 200. For example, the lens of the camera 250 may be dirty or the DFD system 200 may have been set up incorrectly. If a too may double feeds fault occurs, then the DFD system 200 may generate a fault alarm and may shut down its output 280 to the sorter 100. The too many double feeds fault may be automatically reset upon a detected reduction in the number of double feeds.

Typically, the DFD system 200 will determine two types of too many double feeds faults, namely, a "50 in a row OR 5%" fault and a "50in a row OR 50%" fault. Let C be a mail piece count, X be a count increment, and Y be an alarm level. For each passing mail piece, if a double feed is detected, add X to C, otherwise, if a double feed is not detected (i.e. a single feed occurs), subtract 1 from C. Now, for a "50 in a row OR 5%" fault, set X equal to 20 and Y equal to 1,000. The ratio Y/X is equal to 1000/20 or 50. Hence, if there are 50 double feeds in a row, an alarm will be generated and the output 280 to the sorter 100 will be shut down. However, if there are more than 20 (i.e. X) single feeds for each double feed (i.e. 5% double feed occurrence rate), then an alarm will be generated but the output 280 to the sorter 100 will not be shut down.

For a "50 in a row OR 50%" fault, set X equal to 1 and Y equal to 50. The ratio Y/X is again equal to 50. Hence, if there are 50 double feeds in a row, an alarm will be generated and the output 280 to the sorter 100 will be shut down. However, if there are more than 1 (i.e. X) single feeds for each double feed (i.e. 50% double feed occurrence rate), then an alarm will be generated but the output 280 to the sorter 100 will not be shut down.

The presence of a too few double feeds fault or too many double feeds fault may be reported to a user through user interface devices mounted on the panel 291, as described above, or to an external system through the output device 280.

Controller Operation. In general, the controller 270 monitors the photosensors P1 220, P2 230, P3 240, and the vision system 270 to determine if a double feed has occurred. If a double feed is detected by the controller 270, it is reported to the sorter 100 through the output device 280 of the DFD system 200 and to the user locally through the devices mounted on the system panel 291. The controller 270 also performs self-diagnostic functions for the DFD system 200 as described above and maintains statistics including mail piece and double feed counts.

Referring to FIGS. 1, 2, and 3, in operation the controller 270 performs functions including the following:

1. Checks if a mail piece 310 passing through the DFD system 200 is too long. In general, a mail piece will be too long if, for example, the mail piece consists of two overlapping and offset envelopes. To perform this check, the controller 270 monitors photosensors P1 220 and P2 230 as described above. The controller 270 (a) continuously checks when photosensor P1 220 was last unblocked, and (b)

determines that there is a double feed if photosensor P2 230 is blocked and photosensor P1 220 has not become unblocked. In this case, the mail piece 310 is longer than the distance between photosensors P1 220 and P2 230 and therefore the mail piece 310 is a double feed. Alternatively, the mail piece 310 simply may be longer than the longest allowable length in which case it should also be rejected.

2. Checks for a double feed signal from the vision system 260. In general, the vision system 260 will provide a double feed indication if the mail piece 310 consists of, for example, two fully overlapped envelopes (i.e. overlapped but not necessarily offset). The vision system 260 typically provides the controller 270 with a gate signal which indicates that the double feed output is ready for scanning by the controller 270. Upon receipt of the gate signal, the controller 270 will scan the double feed output from the vision system 260 to determine if a double feed condition exists. The double feed output from the vision system 260 is typically a solid state device output or relay contact (e.g. a logical high or a normally open contact).

3. Delays double feed signal output to the sorter 140. If a double feed is detected by either the photosensors P1 220, P2 230 or vision system 260 (i.e. functions 1 and 2 above), then the mail piece 310 will be recorded or marked as a double feed by the controller 270. Typically, two shift registers within the controller 270 may be used. A bit in the first shift register (i.e. the "mail piece present shift register") is set to indicate that a mail piece 310 is passing through the DFD system 200. A bit in the second shift register (i.e. the "double feed shift register") is set to indicate that the mail piece 310 is a double feed. The mail piece present and double feed shift registers are used to delay output of a double feed signal to the sorter 100.

4. Outputs a double feed rejection signal to the sorter processing apparatus 140 via the output device 280 of the DFD system 200. The controller 270 determines if a double feed rejection signal should be output to the sorter 100, 140 by monitoring photosensor P3 240, fault status (as described above), and corresponding bits of the mail piece present and double feed shift registers. When photosensor P3 240 turns on, the controller 260 checks for the setting of corresponding bits for the mail piece in the mail piece present and double feed shift registers. If there is no fault (i.e. alarm), photosensor P3 240 is on, and the corresponding shift register bits are both set, then the controller provides a double feed rejection signal to the sorter 100, 140 via the output device 280. If photosensor P3 240 is on, but no corresponding bits in the shift registers are set, then no double feed rejection signal will be provided to the sorter 100, 140 (i.e. the mail piece is not rejected).

5. Provides fault alarms and statistics to users through the panel 291 of the DFD system 200 or to external systems through the output device 280. As described above, the controller 270 will generate a fault alarm if too many mail pieces are double feeds (e.g. the vision system 260 is malfunctioning). In this event, the controller 270 will turn the double feed rejection signal off. In addition, the controller 270 will generate a fault alarm if too few mail pieces are double feeds. With respect to statistics, the controller 270 maintains and increments counters for both mail pieces passing through the DFD system 200 and for double feeds detected.

6. Provides a setup mode for configuring the DFD system 200. The setup of the DFD system 200 is described in greater detail below. In the setup mode, the controller 270 measures how long it takes for a mail piece to travel from photosensor P2 230 to photosensor P3 240. This information is used to select which bits in the mail piece present and double feed shift registers are to be monitored (i.e. in function 4 above).

Figure 9:
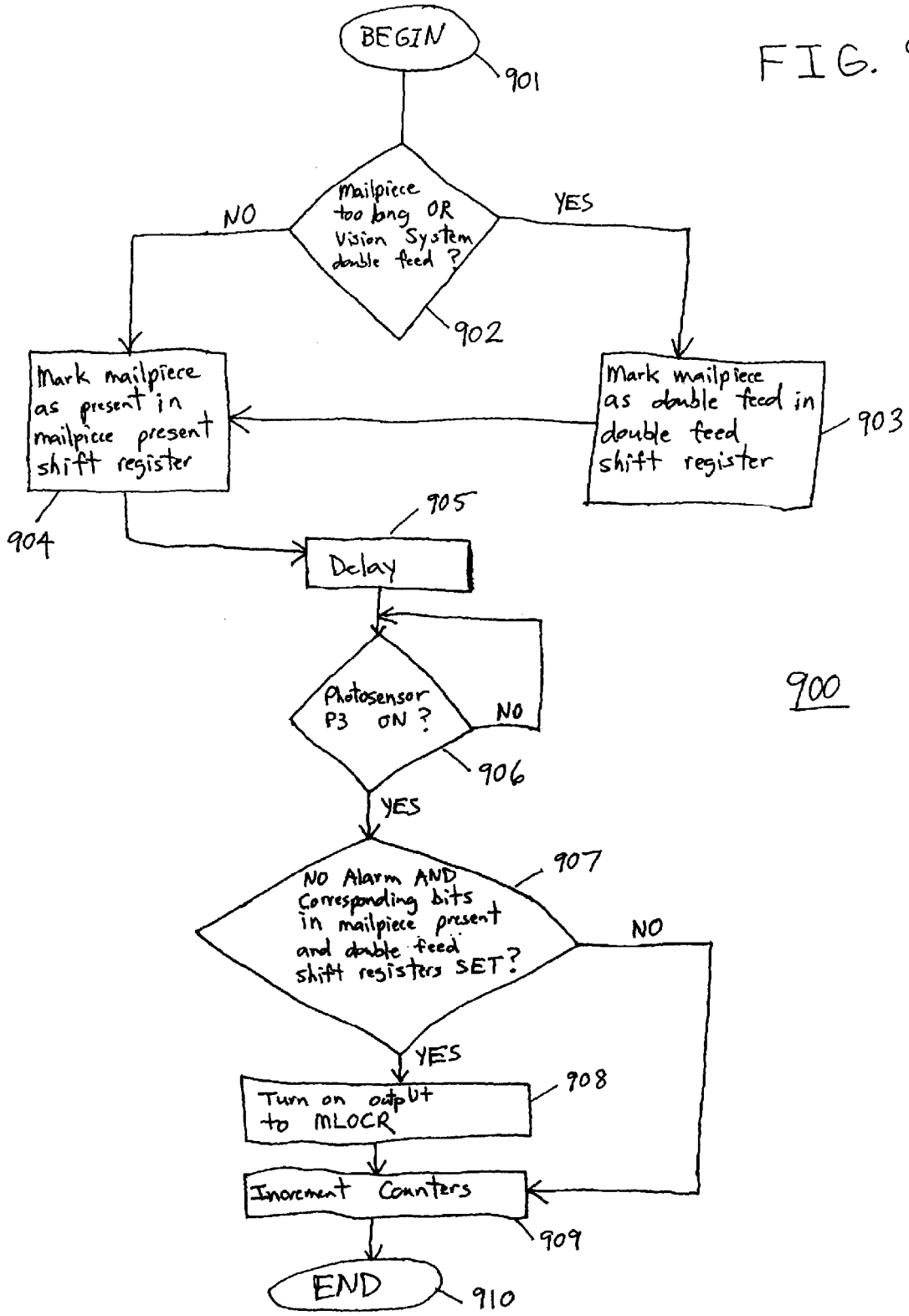
FIG. 9 is a flow chart illustrating a general method for providing a double feed rejection signal to a sorter using a controller in accordance with an embodiment of the invention.

Referring to FIG. 9, there is shown a flow chart 900 illustrating a general method for providing a double feed rejection signal to a sorter 100 using a controller 270 in accordance with an embodiment of the invention. At step 901, the method begins. At step 902, the controller 270 checks if a double feed condition exists by monitoring both the photosensors P1 220, P2 230, and the vision system 260. At step 903, if a double feed condition exists, then the mail piece 310 is marked by setting a bit in the double feed shift register. At step 904, a corresponding bit is set in the mail piece present shift register. At step 905, a delay is introduced to allow the mail piece to travel through the DFD 200 and sorter 100 systems. At step 906, the controller 270 monitors photosensor P3 240 until the mail piece 310 passes. At step 907, when the mail piece 310 arrives at photosensor P3 240, the controller 270 checks for a fault alarm and for the setting of corresponding bits in the mail piece present and double feed shift registers. At step 908, if no alarm if present and if corresponding bits in the mail piece present and double feed shift registers are set, then the double feed rejection signal is turned on. At step 909, the mail piece and double feed counters are incremented. At step 910, the method ends.

Data Carrier Product. The sequences of instructions which when executed cause the method described herein to be performed by the DFD system 200 of FIG. 2 can be contained in a data carrier product according to an embodiment of the invention. This data carrier product can be loaded into and run by the DFD system 200 of FIG. 2.

Computer Software Product. The sequences of instructions which when executed cause the method described herein to be performed by the DFD system 200 of FIG. 2 can be contained in a computer software product according to an embodiment of the invention. This computer software product can be loaded into and run by the DFD system 200 of FIG. 16.

Integrated Circuit Product. The sequences of instructions which when executed cause the method described herein to be performed by the DFD system 200 of FIG. 2 can be contained in an integrated circuit product including a coprocessor or memory according to an embodiment of the invention. This integrated circuit product can be installed in the DFD system 200 of FIG. 2.

In general, the invention described herein provides a double feed detection ("DFD") system for detecting two or more mail pieces (e.g. envelopes), either partially or fully overlapped, passing simultaneously through a mail sorting and handling apparatus.

While the invention is described in relation to a OCR system, it is applicable to a wide variety of mail sorting and handling apparatus including Multi-Line Optical Character Readers (MLOCR), Single Line Optical Character Readers (SLOCR); Bar Code Sorters (BCS); Delivery Bar Code Sorters (DBCS); Enhanced Bar Code Sorters (EBCS); Input Sub System family devices (ISS); Advanced Facer Canceller Systems (AFCS); Advanced Facer Canceller System Input Sub Systems (AFCS ISS); Alcatel Flat Sorter Machines (AFSM); Flat Sorter Machines (FSM); and, Letter Sorter Machines (LSM).

Although preferred embodiments of the invention have been described herein, it will be understood by those skilled in the art that variations may be made thereto without departing from the spirit of the invention or the scope of the appended claims.

What is claimed is:

1. A method for detecting overlapped flat objects in a sequence of flat objects, the flat objects having at least one of their edges exposed for viewing as they pass along a feed path, said method comprising:

selecting a flat object in said feed path;

capturing a digital image of said exposed edges of said selected flat object;

processing at least a portion of said captured image encompassing said edges to determine a pixel density variation in a direction across said edges;

analyzing said pixel density variation to identify maxima and minima in said variation, wherein a start of an edge is identified by a maximum and an end of an edge is identified by a minimum; and counting said maxima and minima to output an indication of a number of edges in said image.

2. The method of claim 1, further comprising determining an edge width of said flat object.

3. The method of claim 2, wherein determining said edge width further comprises:

computing an average pixel density in said processed portion;

assuming a first edge width if said average density is below a predetermined level; and assuming a second edge width if said average density is above said predetermined level.

4. The method of claim 3, wherein counting further comprises:

counting maximum and minimum pairs that are spaced apart by less than said first edge width if said average density is below said predetermined level to output said indication of said number of edges; and counting maximum and minimum pairs that are spaced apart by more than said second edge width if said average density is above said predetermined level to output said indication of said number of edges.

5. The method of claim 4, further comprising:

measuring a pitch between said counted maximum and minimum pairs; and outputting an indication of an overlapped object if said number of edges is greater than or equal to a predetermined number and said average density is above said predetermined level, if said number of edges is greater than said predetermined number and said average density is below said predetermined level, or if said number of edges is equal to said predetermined number and said average density is below said predetermined level and said pitch is greater than a predetermined pitch.

6. The method of claim 1, wherein said flat object is a mail piece.

7. The method of claim 1, wherein said pixel density variation is a ratio of light to dark pixels.

8. The method of claim 3, wherein said average pixel density is a ratio of a total number of light pixels to a total number of dark pixels in said portion of said captured image.

9. The method of claim 5, wherein said predetermined number is two.

10. A system for detecting overlapped flat objects in a sequence of flat objects, said flat objects having at least one of their edges exposed for viewing as they pass along a feed path, said system comprising:

a sensor for generating a signal in response to detecting a flat object in said feed path;

a camera responsive to said signal for capturing a digital image of said exposed edges of said detected flat object in said feed path; and, a vision system coupled to said camera for receiving said digital image; said vision system analyzing at least a portion of said image to determine a pixel density variation along a direction perpendicular to said edges and using said pixel density variation to output an indication of a number of edges in said image.

11. The system of claim 10, wherein an imaging region of said camera is spaced a predetermined distance before said sensor along said feed path.

12. The system of claim 11, wherein said predetermined distance is less than an expected length of said flat object.

13. The system of claim 10, wherein said vision system outputs an overlapped flat object signal if said number of edges is greater than or equal to a predetermined number and a measured average density for said image portion is above a predetermined level, if said number of edges is greater than said predetermined number and said average density is below said predetermined level, or if said number of edges is equal to said predetermined number and said average density is below said predetermined level and a measured pitch is greater than a predetermined pitch.

14. The system of claim 13, further comprising a controller for receiving said overlapped flat object signal from said vision system and said signal from said sensor, wherein said controller:

counts the number of overlapped flat object signals received and the number of signals received and stores an overlapped flat object count and a total flat object count;

outputs a fault signal if said overlapped flat object count increases by a first count without said total flat object count increasing by more than said first count or if said total flat object count increases by more than a second count without said overlapped flat object count increasing; and outputs an overlapped flat object rejection signal if said overlapped flat object signal is received and said fault signal is not output.

15. The system of claim 14, wherein said first count is fifty.

16. The system of claim 15, wherein said second count is twenty.

17. The system of claim 15, wherein said second count is one.

18. The system of claim 14, further comprising:

a first sensor for generating a first signal in response to detecting said flat object in said feed path;

means for receiving said first signal from said first sensor and for outputting a first overlapped flat object signal if said signal from said sensor is received by said controller while said first signal from said first sensor is continuously received by said controller; and means for combining said first overlapped flat object signal with said overlapped flat object signal.

19. The system of claim 18, wherein said first sensor is spaced a first predetermined distance before said sensor along said feed path.

20. The system of claim 19, wherein said first predetermined distance is greater than an expected length of said flat object.

21. The system of claim 14, further comprising:

a third sensor for generating a third signal in response to detecting said flat object in said feed path; and means for delaying the output of said overlapped flat object rejection signal until said third signal is received by said controller.

22. The system of claim 21, wherein said third sensor is spaced a third predetermined distance after said sensor along said feed path.

23. The system of claim 10, wherein said camera is a digital camera.

24. The system of claim 10, wherein said flat object is a mail piece.

25. The system of claim 10, wherein said system is a mail sorting system.

* * * * *